US006872339B2

(12) United States Patent
Schemken et al.

(10) Patent No.: US 6,872,339 B2
(45) Date of Patent: Mar. 29, 2005

(54) APPARATUS AND METHOD FOR THE MELT SPINNING AND DEPOSITING OF A PLURALITY OF TOWS

(75) Inventors: Matthias Schemken, Neumünster (DE); Henning Rave, Leezen (DE); Horst Kropat, Neumünster (DE)

(73) Assignee: Neumag GmbH & Co. KG, Neumunster (DE)

( * ) Notice: Subject to any disclaimer, the term of this patent is extended or adjusted under 35 U.S.C. 154(b) by 323 days.

(21) Appl. No.: 10/117,490

(22) Filed: Apr. 5, 2002

(65) Prior Publication Data

US 2002/0145219 A1 Oct. 10, 2002

(30) Foreign Application Priority Data

Apr. 5, 2001 (DE) ..... 101 16 959

(51) Int. Cl.[7] ..... D01D 4/02; D01D 5/08; D01D 7/00; D01D 13/00; D02G 3/02

(52) U.S. Cl. ..... 264/103; 264/211.12; 425/72.2; 425/135; 425/377; 425/382.2

(58) Field of Search ..... 264/103, 211.12; 425/72.2, 135, 377, 382.2

(56) References Cited

U.S. PATENT DOCUMENTS 3,955,906 A 5/1976 Murase et al. ..... 425/88
4,990,297 A 2/1991 Stibal et al. ..... 264/211.14

FOREIGN PATENT DOCUMENTS

| | | | |
|---|---|---|---|
| DE | 24 39 769 A1 | | 3/1975 |
| DE | 37 08 168 A1 | | 9/1988 |
| DE | 100 39 093 A1 | | 3/2001 |
| DE | 100 15 564 C1 | | 10/2001 |
| JP | 55084410 A | * | 6/1980 |
| JP | 56049009 A | * | 5/1981 |
| WO | WO 01/02633 A1 | | 1/2001 |

OTHER PUBLICATIONS

Patent Abstracts of Japan—JP 55084410, Jun. 25, 1980.
Patent Abstracts of Japan—JP 56049009, May 2, 1981.
European Patent Office Search Report (Feb. 6, 2003).

* cited by examiner

*Primary Examiner*—Leo B. Tentoni
(74) *Attorney, Agent, or Firm*—Kennedy Covington Lobdell & Hickman, LLP

(57) ABSTRACT

A device and a method for the melt spinning and depositing of a plurality of tows (5.1, 5.2, . . . , **5.*n*) utilizes several spinning devices (1.1, 1.2, . . . , 1.*n*) by means of which one of the tows 5.1, 5.2, . . . , 5.*n* is produced from a filament bundle (4.1, 4.2, . . . , 4.*n*). Each spinning device (1.1, 2.2, . . . , 1.*n*) is associated with a respective drawing-off device and a respective can depositing device (3.1, 3.2, . . . , 3.*n*) so that each of the tows (5.1, 5.2, . . . , 5.*n*) can be deposited individually in a respective can (19.1, 19.2, . . . , 19.*n***).

18 Claims, 4 Drawing Sheets

APPARATUS AND METHOD FOR THE MELT SPINNING AND DEPOSITING OF A PLURALITY OF TOWS

CROSS-REFERENCES TO RELATED APPLICATIONS

This application claims the benefit of German patent application DE10116959.0 filed Apr. 5, 2001, herein incorporated by reference.

BACKGROUND OF THE INVENTION

The present invention relates to an apparatus and a method for the melt spinning and depositing of a plurality of tows.

It is known for the production of staple fibers that initially a plurality of filaments from a polymer melt are spun by extrusion in a first process step. After the extrusion, the filaments are combined into the form of a tow and deposited as tow in a can. In a second process step, the tow is drawn out of the can and cut after several treatment stages by a fiber cutter to the staple fiber.

The present invention relates to an apparatus and method for carrying out the first process step. In known apparatus and methods, filament bundles are extruded in several spinning devices arranged in series and combined into a tow after they have cooled. The tows of the individual spinning devices are drawn off by a common drawing-off device and combined to a tow. The tow is deposited in a can by a can depositing device.

The problem occurs in the known devices that the entire process must be interrupted in the case of disturbances or stoppages of any one of the spinning devices, or if during the cleaning of a spinning position, for example, the tow is no longer in order in the can. Another disadvantage of such devices is in the spreading of the tow bundle, consisting of several tows, especially in large denier of the filament bundle of, e.g., >12,000 dtex.

SUMMARY OF THE INVENTION

In view of the above state of the art, it is an object of the invention to develop an improved device and method of the basic type described above that will enable flexible production of tows with low outage times and a low amount of rejects.

This objective is addressed in accordance with the present invention by providing an apparatus and a method for the melt spinning and depositing of a plurality of tows utilizing a plurality of spinning devices each adapted for producing a tow from a filament bundle, a plurality of drawing-off devices each associated with a respective one of the spinning devices for withdrawing the tow from the associated spinning device, and a plurality of can depositing devices each associated with a respective one of the spinning devices and a respective one of the drawing-off devices for collecting the tow from the associated drawing-off device into a can. The method of melt spinning and depositing of plural tows carried out by the apparatus comprises the steps of spinning a plurality of filament bundles at parallel adjacent locations defined by the plural spinning devices, combining each filament bundle into a tow, drawing off the tows independently of each other by the respective drawing-off devices, and depositing the tows independently of each other individually into respective cans associated with each respective tow. Other advantageous embodiments and further developments, that can be used individually or combined as desired with each other, are the subject of particular preferred embodiments.

The present invention is distinguished in that every tow spun in one of the spinning devices can be individually guided, treated and deposited in a separate respective can. This prevents any disturbances in any spinning position of the spinning line and also during the spreading in the drawing-off device from influencing any of the other tows at other positions. To this end, a corresponding plurality of drawing-off devices and can depositing devices are provided for the spinning devices so that each spinning device is associated with a respective drawing-off device and a respective can depositing device. A further, substantial advantage of the invention is that small and readily serviceable cans can be used for the further processing of the tows, which results in advantages of space and of transport, especially in compact systems.

In an especially advantageous further development of the invention, the drawing-off devices and the can depositing devices are designed so that they can be controlled independently of each other. This makes it possible to manufacture tows in a device with different denier, during which the textile properties can be adjusted in an advantageous manner. Thus, for example, drawing-off devices can be individually operated at different drawing-off speeds. Furthermore, maintenance work and repairs of individual drawing-off devices and depositing devices can be carried out without interrupting the adjacent spinning lines.

In order to further raise the flexibility of manufacturing tows, an advantageous further development of the invention provides for combining the spinning device, the drawing-off device and the can depositing device for the production and depositing of one of the tows at one spinning position that can be controlled independently of the adjacent spinning positions. However, it is also possible that only groups of spinning positions are combined and jointly controlled.

It is therefore especially advantageous if each spinning position is associated with one of several melt producers. For example, an extruder designed as a melt producer can be associated with each spinning position. However, it is also possible that one group of spinning positions or all spinning positions are jointly supplied by one melt producer. Polycondensation devices or extruders can be used as melt producers.

In order to combine the filament bundles individually into the tows, preparation devices are provided that can be controlled independently of each other. The preparation devices are advantageously designed as roller preparation devices with several rollers. However, they can also contain preparation pins or different oilers.

The design of the device of the present invention is also distinguished in that no substantial deflection of the filament bundles or of the tows takes place between the treatment stages. To this end the spinning device, drawing-off device and the can depositing device are superposed over each other.

It is especially advantageous if the drawing-off devices and/or the can depositing devices are arranged adjacent to each other in one mounting plane. This assures a servicing and monitoring of all individually controllable drawing-off devices. However, it is also possible to arrange the entire spinning position in one mounting plane in order to save building height in an advantageous manner.

The device in accordance with the invention is especially suitable for high melt throughputs in the spinning devices of over 500 kg/h with a correspondingly high number of nozzle holes in the spinning nozzle.

In order to achieve a uniform cooling of all filaments within the filament bundle after the extruding step given the great filament density in the filament bundle, a further development of the device of the invention provides for a blowing element to be arranged below the spinning nozzle the air supply of which penetrates the annular spinning nozzle. To this extent, a spreading of the filament bundle is not required at any position of the filament curtain. The blowing element thus extends into the interior of the freshly extruded filament bundle and guides the cooling medium flowing from the interior radially to the outside uniformly against the filaments of the filament bundle.

In order to avoid an inadmissible widening of the filament bundle during and after the cooling step, another advantageous embodiment of the device in accordance with the invention provides an outer preparation ring arranged below the blowing element that surrounds the filament bundle in an annulus and thus makes possible a moistening of the filament bundle from the outside. The outer preparation ring is advantageously formed by two structural components that can move against each other. However, another preparation ring can also be advantageously arranged inside the filament bundle so that the filament curtain is moistened from the interior. The use of two preparation rings is especially advantageous, so that a moistening can take place from the outside and from the interior, which results in an especially uniform preparation of all filaments of the filament bundle.

In order to make possible a continuous further processing of the freshly deposited tows, the can depositing devices are advantageously connected to an automatic can lattice loading.

Several tows can be spun parallel to and adjacent to each other with a high degree of flexibility and deposited by the invention. Compared to the known methods of manufacture, the invention is particularly distinguished in that different tows can be produced simultaneously when several spinning devices are used. The differences in the tows can be in the denier, in the polymer type or also in the physical properties of the tow.

Several exemplary embodiments of the device in accordance with the invention are described in detail in the following disclosure with reference made to the attached drawings.

DESCRIPTION OF THE PREFERRED EMBODIMENTS

Figure 1:
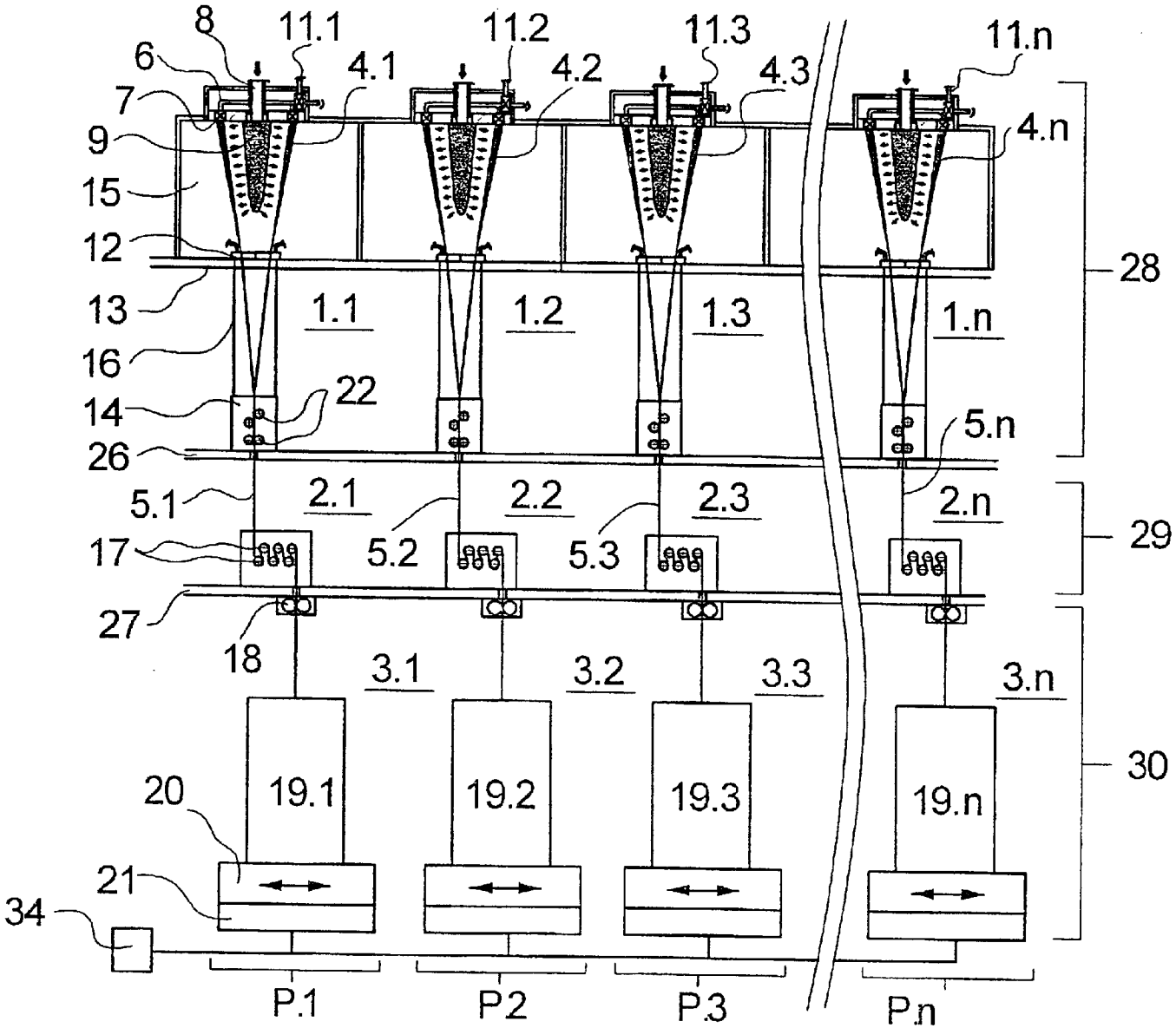
FIG. 1 shows a schematic view of a first exemplary embodiment of the device in accordance with the invention.
Figure 2:
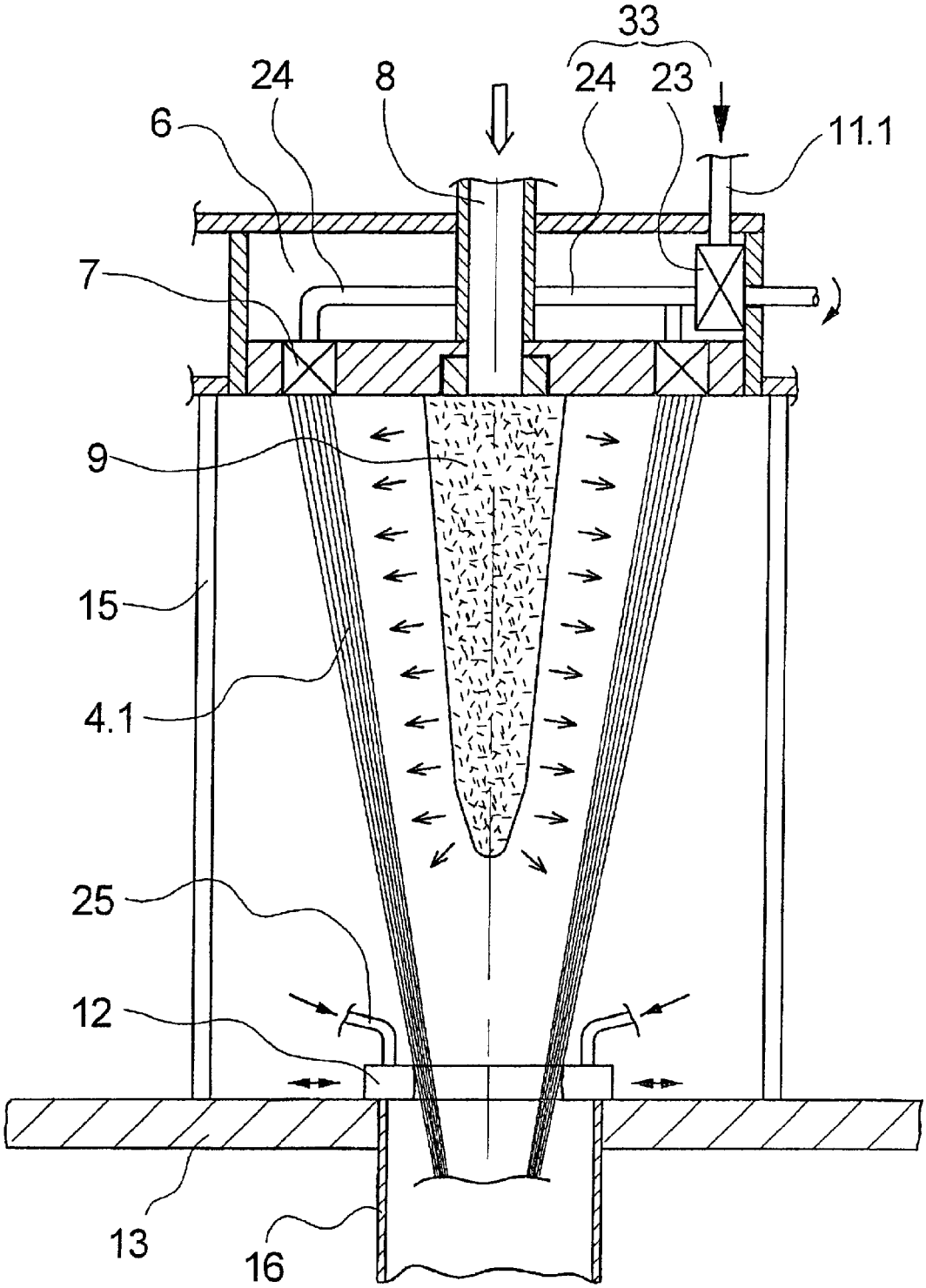
FIG. 2 shows a schematic view of the spinning device of FIG. 1.

FIG. 1 shows a first exemplary embodiment of a spinning apparatus in accordance with the present invention in a schematic view representatively depicting the multiple spinning devices 1.1, 1.2, 1.3 . . . **1.*n*, where n represents the total number of the spinning devices of which the apparatus is comprised. The apparatus may comprise any desired number of the spinning devices 1.1, 1.2, 1.3 . . . 1.*n*, forming a corresponding plurality of spinning positions P.1 to P.n, only four of which spinning devices with their spinning positions being shown by way of example in FIG. 1. At each spinning position P.1 to P.n, a spinning device 1.1 to 1.*n*, a drawing-off device 2.1 to 2.*n* and a can depositing device 3.1 to 3.*n* are arranged in a superposed relation to one another at differing elevational levels defined by first, a second and a third frame plates 13, 26, 27, respectively. The first frame plate 13 is arranged above the second frame plate 26 and the second frame plate 26 is arranged above the third frame plate 27. Spinning devices 1.1 to 1.*n* are arranged above second frame plate 26 and form a spinning stage 28. Drawing-off devices 2.1 to 2.*n* are arranged between second frame plate 26 and third frame plate 27 and form a drawing-off stage 29. Can depositing devices 3.1 to 3.*n* are arranged under third frame plate 27 and form depositing stage 30. Spinning devices 1.1 to 1.*n*, drawing-off devices 2.1 to 2.*n* and can depositing devices 3.1 to 3.*n* are arranged adjacent to each other at their respective levels. Each spinning position P.1 to P.n is supplied with melt via molten polymer, commonly referred to as the melt, via respective melt feeds 11.1 to 11.*n*. FIG. 2 depicts one of spinning devices 1.1 to 1.*n*** in a partially enlarged schematic view.

Each spinning device 1.1 to **1.*n* comprises a spinning head 6 comprising on its bottom end an annular spinning nozzle 7 and air supply 8 arranged concentrically to the spinning nozzle 7. Spinning head 6 is heatable and comprises a melt supply line 24 to spinning nozzle 7. A polymer melt delivered by a melt producer (not shown) is supplied via melt feed 11.1 to 11.*n* to spinning head 6. Melt feed 11.1 to 11.*n* extends to spinning pump 23 connected via the melt lines 24 to spinning nozzle 7**.

Each spinning device 1.1 to **1.*n* comprises cooling shaft 15 and a following gravity tube 16 below spinning head 6. Blowing element 9 is arranged inside cooling shaft 15 under spinning head 6 and is connected to air supply 8. Blowing element 9 comprises an air-permeable, porous jacket (as indicated by shading) so that a cooling medium, preferably cooling air, flows radially outwardly from the jacket of blowing element 9 via air supply 8 into the interior of the blowing element 9. An outer preparation ring 12 is arranged on the outlet side of cooling shaft 15. Cooling shaft 15 and gravity tube 16 are separated by a first base plate 13.1 and gravity tube 16 is arranged substantially concentrically to and immediately following the cooling shaft 15**.

Preparation device 14 is arranged on the lower outlet end of gravity tube 16 and comprises several preparation rollers 22 arranged in series in the traveling course of the yarn. Preparation device 14 is designed as a structural component and is supported on the second base plate 26. Preparation device 14 forms the outlet of the spinning device 1.1 to **1.*n***, that thus extends over at least two levels.

In a level located under the spinning device 1.1 to **1.*n*, a drawing-off device 2.1 to 2.4*n* is associated with each spinning device 1.1 to 1.*n*. Drawing-off devices 2.1 to 2.*n* each have several draw-off rollers 17 arranged in series and offset in a horizontal line. Draw-off rollers 17 are arranged on the third base plate 27 and are driven. Drawing-off devices 2.1 to 2.*n* are designed as independent structural components and can be controlled independently of each other via separate drives. For this purpose, drawing-off devices 2.1 to 2.*n*** are arranged in series in one mounting level.

Can depositing devices 3.1 to **3.*n* are also located in series in a mounting level below drawing-off devices 2.1 to 2.*n*. Can depositing devices 3.1 and 3.*n* comprise transport mechanism 18, can 19.1 to 19.*n* arranged below transport mechanism 18 and a can traversing device 20 that receives can 19.1 to 19.*n*. Can depositing devices 3.1 to 3.*n* are also designed as independent structural components with separate drives and controls. Can depositing devices 3.1 to 3.*n* are each associated with conveyor belt 21 that makes possible replacement and removal of cans 19.1 to 19.*n* to an automatic can lattice loading 34**.

In the apparatus shown in FIG. 1 and FIG. 2, a polymer melt is produced by a melt producer (not shown), e.g., an extruder, of a polycondensation device and supplied via melt feeds 11.1 to **11.*n* to spinning devices 1.1 to 1.*n*. The polymer melt is supplied under pressure to spinning nozzles 7 of spinning devices 1.1 to 1.*n* with the aid of a melt supply device 31 like the one formed, e.g., by pump 23 and the melt supply lines 24. An extruding of stranded filaments takes place through the perforations of spinning nozzle 7 so that a plurality of annularly arranged filaments result in a filament bundle 4.1 to 4.*n*. Spinning nozzle 7 can have a number of nozzle bores greater than 8,000 in order to generate a high throughput of over 500 kg/h as well as a high filament density. Thus, a filament bundle 4.1 to 4.4*n* is produced in each spinning device 1.1 to 1.*n*. The filaments of filament bundle 4.1 to 4.*n* enter into the respective cooling shaft 15. A cooling medium, preferably a cool air, is blown thereby by blowing element 9 substantially in a radial direction against the filaments. The filaments are drawn off under a drawing-off tension of the respective drawing-off device 2.1 to 2.*n* from the spinning nozzle 7 and are moistened after cooling by the outer preparation ring 12 arranged on the outlet side of cooling shaft 15. The outer preparation ring 12 collects the filament bundle 4.1 to 4.*n* and produces a uniform moistening of all filaments within filament bundle 4.1 to 4.*n*. Outer preparation ring 12 is connected to this end to a first preparation feed 25. The outer preparation ring 12** is preferably formed from two segment-like structural components that are held against one another in operation and thus uniformly enclose the collected filament bundle.

After passing through gravity tube 16, the filament bundle 4.1 to **4.*n* is guided through preparation device 14. Thereafter, another moistening of the filaments as well as a closure of the filament bundle 4.1 to 4.*n* into the form of a tow 5.1 to 5.*n* takes place. The tow 5.1 to 5.*n* is drawn off from preparation device 14 by the drawing-off device 2.1 to 2.*n*. The tow 5.1 to 5.*n* is conducted via several driven draw-off rollers 17 to the can depositing device 3.1 to 3.*n*. The tow 5.1 to 5.*n* is deposited in can depositing device 3.1 to 3.*n* by transport mechanism 18 into the respective can 19.1 to 19.*n*. Transport mechanism 18 could be designed, e.g., as a depositing reel. In order to fill the can 19.1 to 19.*n*, the can is moved back and forth by can traversing device 20. The can 19.1 to 19.*n* could be designed as a rectangular can or as a round can. The full can 19.1 to 19.*n* is replaced by an empty can via conveyor belt 21** for can replacement.

In The apparatus according to FIG. 1, the tows 5.1 to **5.*n* are deposited next to each other simultaneously into a respective one of cans 19.1 to 19.*n*. The manufacture and depositing of tows 5.1 to 5.*n* can be carried out in a flexible manner by independently controllability of the drawing-off devices 2.1 to 2.*n* and can depositing devices 3.1 to 3.*n* within the respective spinning position P.1 to P.n. In case of an outage of one of the spinning devices 1.1 to 1.*n*, a continuation of the production of the adjacent tows 5.1 to 5.*n* is assured. There is also the possibility of processing different polymers by separate melt producers (not shown) in any one of the spinning positions P.1 to P.n or in any selected group of spinning positions P.1 to P.n. Likewise, tows 5.1 to 5.*n* with different physical properties can be produced by independently driving drawing-off devices 2.1 to 2.*n*** differently from each other.

Figure 3:
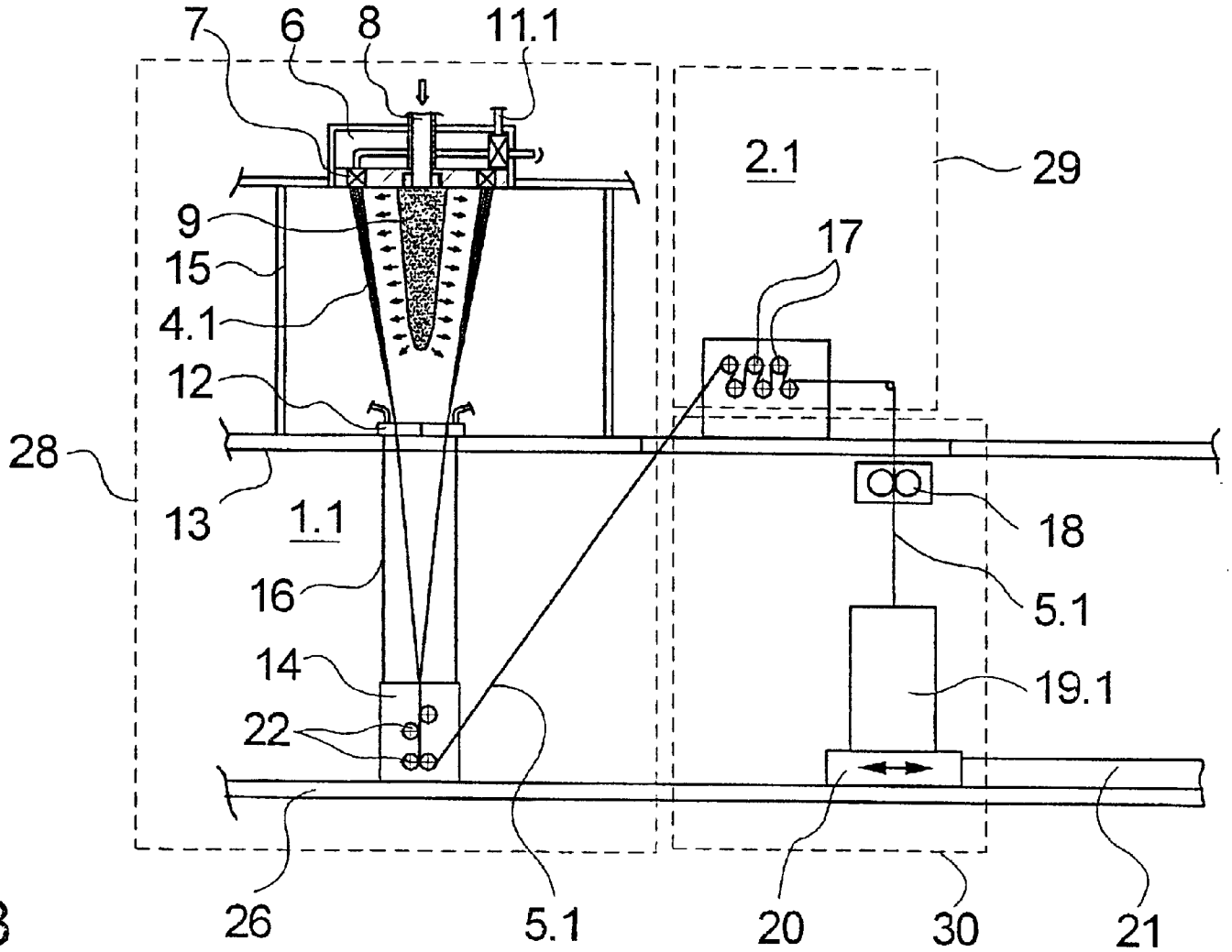
FIG. 3 shows a schematic view of another exemplary embodiment of a device in accordance with the invention.

FIG. 3 shows another exemplary embodiment of the apparatus in accordance with the invention. Only one of the spinning positions P.1 to P.n is shown in this Figure in a side view. The adjacent spinning positions P.1 to P.n are located at the machine front extending vertically to the plane of the drawing.

In the apparatus shown in FIG. 3, the structural components with the same function are provided with identical reference numerals as in FIGS. 1 and 2. The design of the device is substantially identical to the previous exemplary embodiment of FIGS. 1 and 2 so that only the differences are discussed in the following description. In contrast to the previous exemplary embodiment, the device in accordance with FIG. 3 is designed to be distributed substantially over only two elevational levels. The spinning device 1.1 to **1.*n* extends over two levels. The drawing-off device 2.1 to 2.*n* and the can depositing device 3.1 to 3.*n* are arranged together in superposed relation to the side of the spinning device 1.1 to 1.*n*. To this end, the tow 5.1 to 5.*n* is deflected at the output of roller preparation device 14 and conveyed to the drawing-off device 2.1 to 2.*n* arranged in the upper level. The drawing-off device 2.1 to 2.*n* and the can depositing device 3.1 to 3.*n* are designed identically to the preceding exemplary embodiment. The removal of cans 19.1 to 19.*n* takes place thereby via conveyor belt 21 along the plane of the drawing to an automatic can lattice loading 34**.

Figure 4:
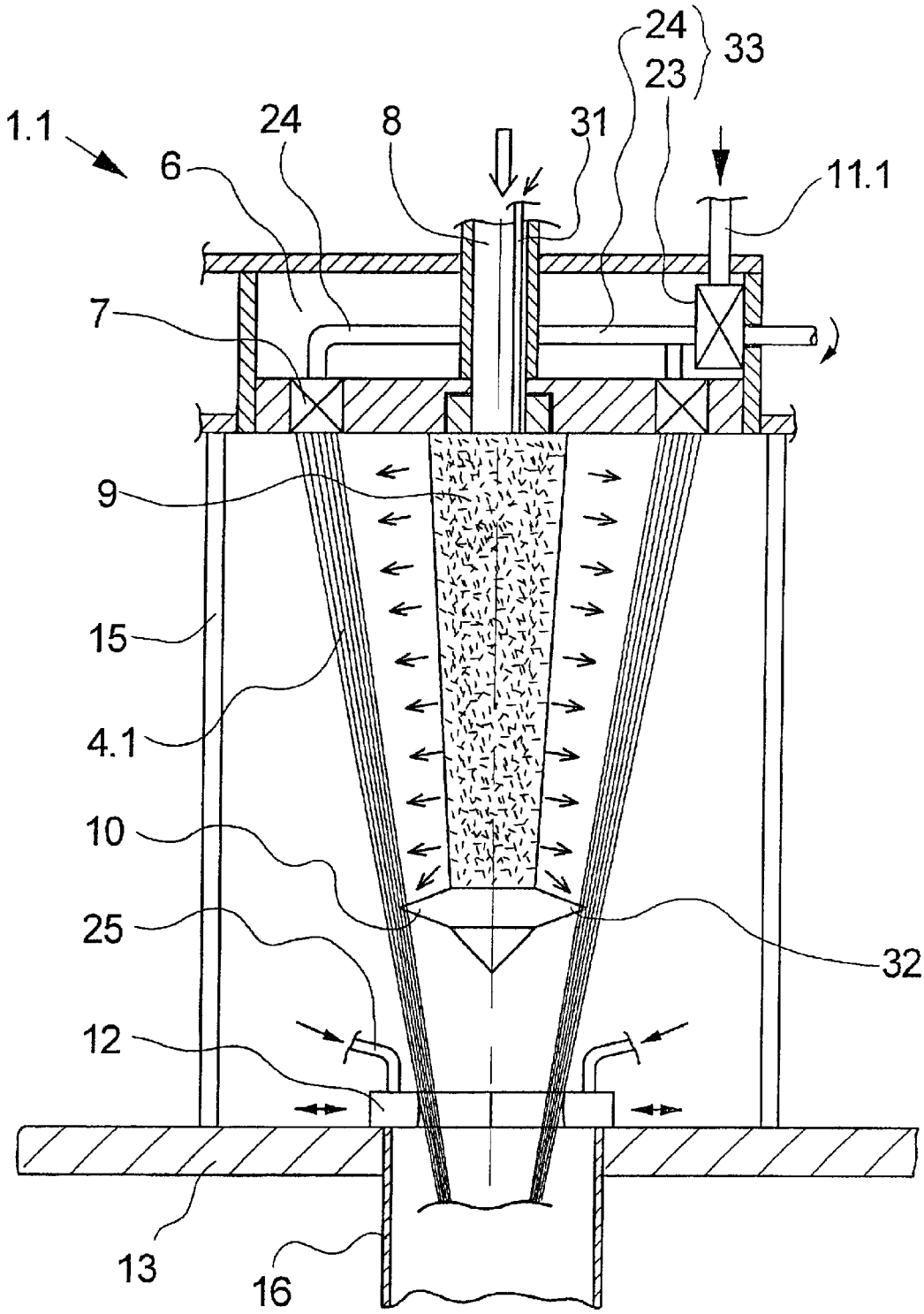
FIG. 4 shows a schematic view of another exemplary embodiment of a spinning device.

FIG. 4 shows another exemplary embodiment of a spinning device like the one that could be used, e.g., in the device in accordance with the invention and according to FIG. 1 or FIG. 3. The structural components in this drawing that have the same function are provided with identical reference numerals. The design of the spinning device is substantially identical to the exemplary embodiment according to FIG. 2 so that in the following description only the differences are indicated and reference is made to the previous description for FIG. 2.

Blowing element 9, and an inner preparation ring 10 disposed on the free end of blowing element 9, are arranged below spinning head 6 within cooling shaft 15. Inner preparation ring 10 is connected to a second preparation feed 33 extending via air supply 8 from spinning head 6 through blowing element 9. Inner preparation ring 10 is designed in the form of a disk with an annularly circumferential moistening edge 32 of the inner preparation ring 10 extending to the traveling plane of filaments 4.1 to **4.*n***.

At a spacing below inner preparation ring 10, a second, outer preparation ring 12 is provided that surrounds the filament bundle 4.1 to **4.*n* and is connected to a first preparation feed 25. The outer preparation ring 12 is constructed in accordance with the previously cited exemplary embodiment according to FIG. 2**.

In the spinning device 1.1 to **1.*n* shown in FIG. 4, the filament bundle 4.1 to 4.*n* spun by annular spinning nozzle 7 is moistened after being initially cooling by inner preparation ring 10 from the inside with a preparation means. Then, a second moistening subsequently takes place from the outside by outer preparation ring 12. This achieves a uniform moistening of all filaments of the filament bundle 4.1 to 4.*n***.

The exemplary embodiments of the apparatus in accordance with the invention shown in FIGS. 1 to 4 are exemplary in their design. Thus, additional treatment devices as well as similar design variants can be made. The invention comprises all devices for melt spinning and deposition several tows 5.1 to **5.*n* in which the tow 5.1 to 5.*n* produced from a filament bundle 4.1 to 4.*n* is deposited individually in an associated can 19.1 to 19.*n***.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for the melt spinning and depositing of a plurality of tows, the apparatus comprising a plurality of spinning devices, each spinning device being adapted for producing a single respective tow from a filament bundle, a plurality of drawing-off devices corresponding in number to the spinning devices, each drawing-off device being associated with only a respective one of the spinning devices for withdrawing only the single respective tow from the associated spinning device, and a plurality of can depositing devices corresponding in number to the spinning devices, each can depositing device being associated with only a respective one of the spinning devices and a respective one of the drawing-off devices for collecting only the single respective tow from the associated drawing-off device into a can.

2. The apparatus according to claim 1, characterized in that the respective drawing-off devices and the respective can depositing devices are controllable independently of each other.

3. The apparatus according to claim 2, characterized in that each associated spinning device, drawing-off device and can depositing device form a spinning position for producing and depositing one of the tows, at least some of the spinning positions being controllable independently of each other.

4. The apparatus according to claim 3, characterized in that each spinning position is associated with a respective melt producer.

5. The apparatus according to claim 1, characterized in that a respective preparation device for forming a tow is associated with each of the spinning devices, the preparation devices being controllable independently of each other.

6. The apparatus according to claim 1, characterized in that each associated spinning device, drawing-off device and can depositing device are arranged in superposed relation.

7. The apparatus according to claim 6, characterized in that the associated drawing-off device and the associated can depositing device are arranged adjacent to each other in a mounting plane.

8. The apparatus according to claim 1, characterized in that each spinning device has an annular spinning nozzle and a blowing element arranged beneath the spinning nozzle, the blowing element being disposed centrally within the spinning nozzle and connected to an air supply.

9. The apparatus according to claim 8, characterized in that the spinning nozzle of at least one of the spinning devices contains at least more than 8000 nozzle bores.

10. The apparatus according to claim 8, characterized in that an outer preparation ring is arranged in the direction of travel of the filament bundle beneath the blowing element for surrounding and moistening the filament bundle, the outer preparation ring comprising at least two structural components movable toward each other.

11. The apparatus according to claim 1, characterized in that the can depositing devices are connected to an automatic can lattice loading.

12. A method for the melt spinning and depositing of a plurality of tows, the method comprising the steps of spinning a plurality of filament bundles at parallel adjacent locations, combining each filament bundle into a single respective tow, drawing off each of the tows independently of each other by respective drawing-off devices each associated with only a respective one of the tows, and depositing the tows independently of each other individually into respective cans each associated with only a respective one of the tows.

13. The method according to claim 12, characterized in that the can depositing devices are controllable independently of each other to draw off and deposit the tows.

14. The method according to claim 12, characterized in that the filament bundles of the tows are extruded independently of each other by separate spinning devices.

15. The method according to claim 12, characterized in that the filament bundles of the tows are extruded jointly in parallel by a respective plurality of spinning devices.

16. A method for the melt spinning and depositing of a plurality of tows, the method comprising the steps of spinning a plurality of filament bundles at parallel adjacent locations, combining each filament bundle into a tow, drawing off the tows independently of each other by respective drawing-off devices, and depositing the tows independently of each other individually into respective cans associated with each respective tow, wherein the can depositing devices are controllable independently of each other to draw off and deposit the tows.

17. The method according to claim 16, characterized in that the filament bundles of the tows are extruded independently of each other by separate spinning devices.

18. The method according to claim 16, characterized in that the filament bundles of the tows are extruded jointly in parallel by a respective plurality of spinning devices.

* * * * *